US006445295B1

(12) United States Patent
Abshire et al.

(10) Patent No.: US 6,445,295 B1
(45) Date of Patent: Sep. 3, 2002

(54) BURGLAR PROOF ICE CHEST

(76) Inventors: Gerald Abshire, 307 L. DuBois Rd., New Iberia, LA (US) 70560; Kevin Abshire, 307 L. DuBois Rd., New Iberia, LA (US) 70560

( * ) Notice: Subject to any disclaimer, the term of this patent is extended or adjusted under 35 U.S.C. 154(b) by 81 days.

(21) Appl. No.: 09/652,539

(22) Filed: Aug. 31, 2000

(51) Int. Cl.[7] ..... G08B 13/14

(52) U.S. Cl. ..... 340/571; 340/545.6; 340/545.5; 340/568.1; 340/568.2; 340/825.46; 340/615

(58) Field of Search ..... 340/571, 572.1, 340/545.6, 545.5, 566, 568.1, 568.2, 580, 581, 582, 584, 585, 614, 615, 618, 689, 825.46

(56) References Cited

U.S. PATENT DOCUMENTS 6,118,375 A * 2/2000 Duncan ..... 340/541
6,271,753 B1 * 3/2000 Shuka ..... 340/545.6

* cited by examiner

*Primary Examiner*—Jeffery Hofsass
*Assistant Examiner*—Daniel Previl
(74) *Attorney, Agent, or Firm*—Joseph N. Breaux

(57) ABSTRACT

An ice chest which incorporates a mechanism for alerting an owner or user that an unauthorized individual is tampering with the ice chest contents or the ice chest itself. Burglar proof ice chest 10 includes a lid 12 and a bottom portion 14 with a spring loaded activation switch. Opening the lid portion generates the audible alarm output.

1 Claim, 3 Drawing Sheets

FIG.3
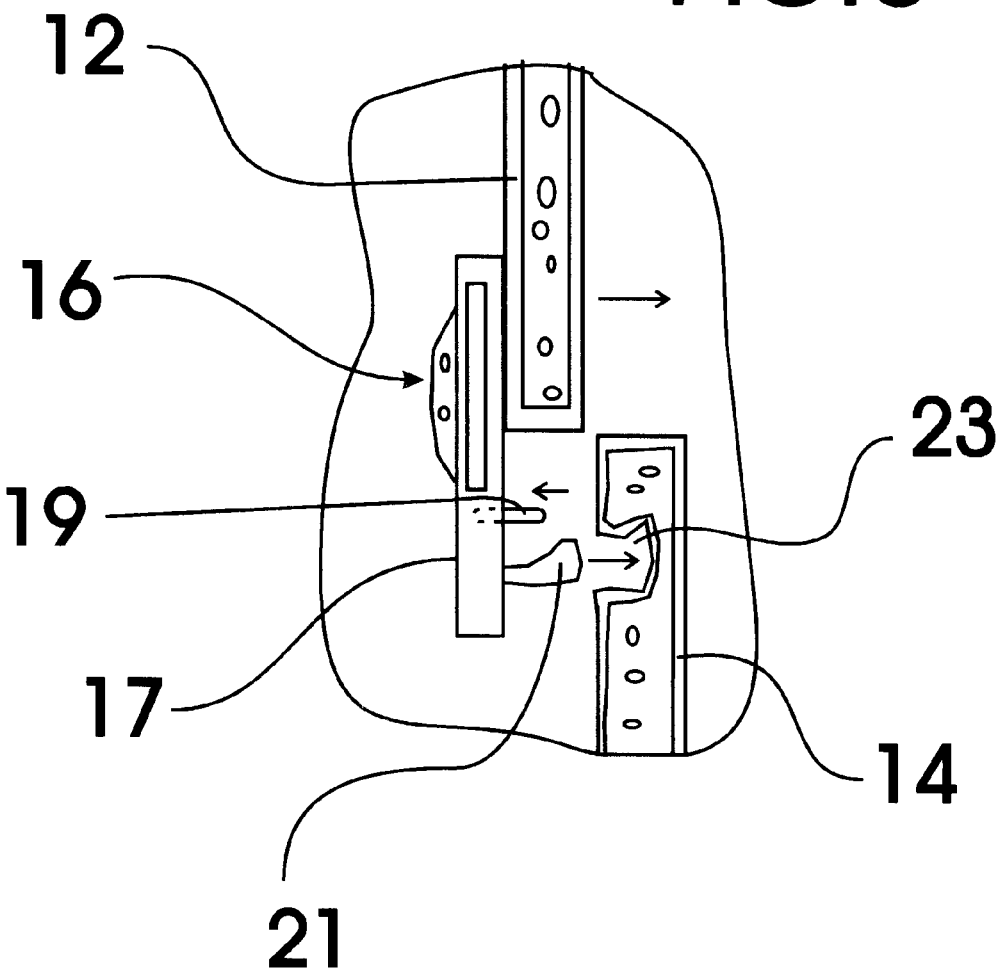
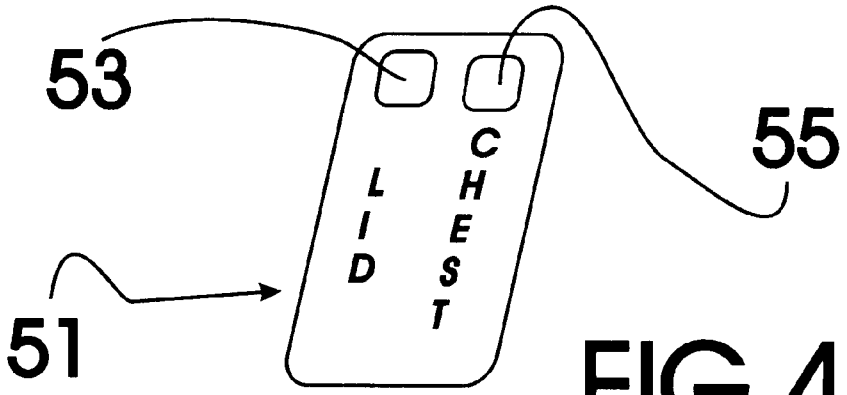
FIG.4

BURGLAR PROOF ICE CHEST

TECHNICAL FIELD

The present invention relates to ice chests and more particularly to an ice chest which incorporate a first alarm mechanism in connection with the lid of the ice chest for alerting a user of the ice chest that an unauthorized individual is tampering with the contents of an ice chest and a second alarm mechanism and a second alarm mechanism connectable between the ice chest and a user inserted ground stake that alerts the user of the ice chest that an unauthorized individual is attempting to take the ice chest.

BACKGROUND OF INVENTION

Many individuals find it convenient to carry an ice chest to remote locations, such as the beach or a park, to keep drinks and food refrigerated for later use. Although ice chests are a convenient source to keep food and drink items at a proper storage temperature, it is typically bothersome to maintain visual sight of the ice chest to secure the contents of the ice chest as well as the ice chest itself. It would be a benefit, therefore, to have an ice chest that included an alarm system which included an open lid alarm mechanism which sounded and alerted each time the lid was opened as well as a movement sensing alarm mechanism which provided an audible alarm when the ice chest was moved from a predetermined fixed location.

SUMMARY OF INVENTION

It is thus an object of the invention to provide a burglar proof ice chest that includes a lid opening alarm as well as an ice chest movement alarm.

Accordingly, a burglar proof ice chest is provided. The burglar proof ice chest includes a dual mode alarm system which sounds an alert when anyone either opens the lid or moves the cooler/ice chest. An internal switch positioned within the lid activates the alarm each time the lid is opened. The bottom of the cooler is attached to a ground anchor attachment stake by means of a cable and an activation pin set up that activates the alarm in the event the pin is pulled from between the two alarm contacts that it separates when a thief or the like attempts to make off with the cooler. The anchor preferably includes a screw type of mechanism which is screwable into the ground. The anchor has an open eye to which a steel cable or the like is attached at one end. The other end of the cable is permanently secured to the activation pin.

The alarms are each battery powered installed within watertight compartments of the ice chest. The output of each of the alarms is loud enough to be heard at least 50 to 100 feet away. A key pad may be provided for the user to deactivate the alarm system prior to accessing the interior of the ice chest or moving the ice chest to a different location. A remote deactivate controller could be provided for a more expensive version of the ice chest.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 3 is a cross section view through the lid alarm showing the spring loaded activation pin and the lid alarm control circuit positioned within the lid latch structure.

FIG. 4 is a top plan view of the dual alarm remote control unit.

EXEMPLARY EMBODIMENTS

Figure 1:
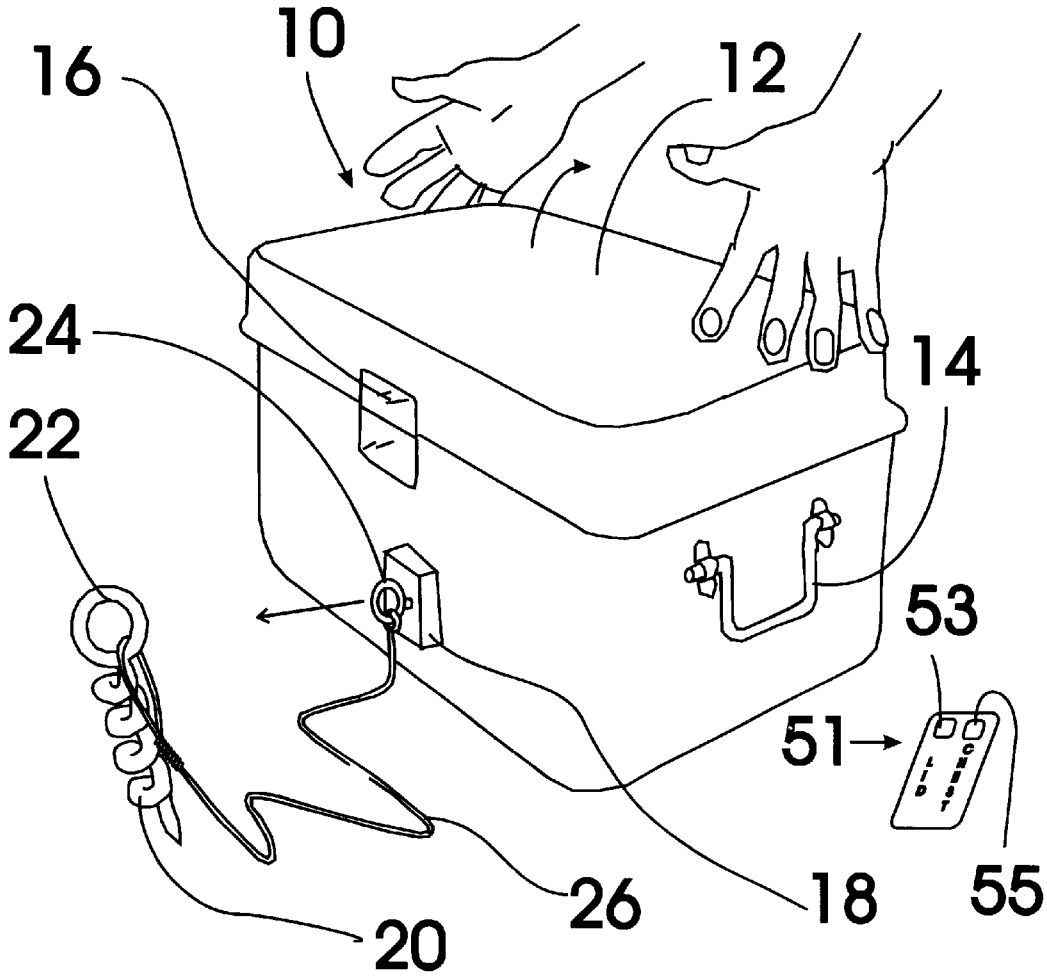
FIG. 1 is a perspective view showing an exemplary embodiment of the burglar proof ice chest of the invention showing the ice chest, the anchor, the cable, the activation pin, the chest removal alarm housing, the lid alarm and the remote control alarm deactivation unit.
Figure 2:
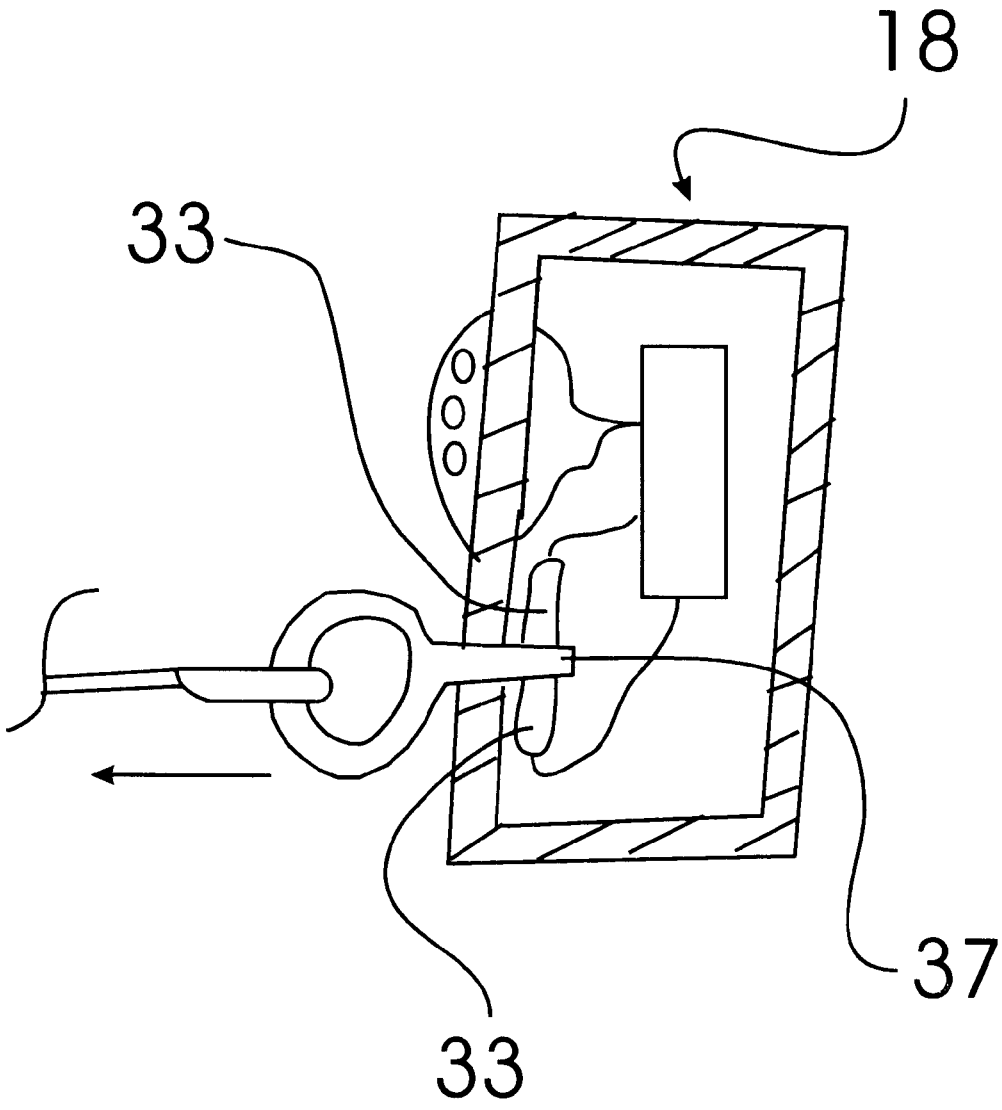
FIG. 2 is a cross sectional view through the chest removal alarm housing showing the shaft portion of the alarm activation pin inserted between the spring loaded alarm activation contacts, the alarm circuit, and the alarm speaker.

FIGS. 1–3 show various aspects of an exemplary embodiment of the burglar proof ice chest of the present invention generally designated 10. Burglar proof ice chest 10 includes a lid 12 and a bottom portion 14. Lid 12 includes a lid alarm 16 for making an audible output when lid 12 is opened. In this embodiment, lid alarm 16 is constructed within a lid latch 17 and includes a spring loaded activation switch that is compressed and held down when the latching head 21 of lid latch 17 is fully inserted into a latching head cavity 23 formed within bottom portion of ice chest 10.

Burglar proof ice chest 10 also includes an anchoring alarm designated 18 which includes an alarm box assembly 31 having a pair of spring loaded alarm activation contacts 33, an anchor 20 including an open eye 22, an ice chest activation pin 24 having a shaft 37 positioned between and separating alarm contacts 33, and a steel cable 26. Steel cable 26 is attached between eye 22 and activation pin 24. When ice chest 10 is moved activation pin is pulled out allowing alarm contacts 33 to contact each other activating the audible alarm. In this embodiment lid alarm 16 and anchoring alarm 18 are each armed and disarmed by a remote control unit 51. Remote control unit 51 has a lid arm/disarm button 53 and an anchoring alarm arm/disarm button 55.

It can be seen proceeding description that a burglar proof ice chest has been provided that includes a lid opening alarm for detecting when the lid is opened and an anchoring alarm for detecting when the ice chest is moved beyond a predetermined location.

What is claimed is:

1. A burglar proof ice chest comprising:

an ice chest having a lid portion and a bottom portion; and a remote control unit;

said lid portion including a lid alarm for generating an audible alarm output when said lid portion is opened;

said lid alarm being constructed within a lid latch of said lid portion and including a spring loaded activation switch that is compressed and held down when a latching head of said lid latch is fully inserted into a latching head cavity formed within said bottom portion;

said burglar proof ice chest further including an anchoring alarm in connection therewith having an alarm box assembly having a pair of spring biased alarm activation contacts, an anchor including an open eye, an ice chest activation pin having a shaft positioned between and separating said alarm contacts, and a cable;

said cable being attached between said open eye and said activation pin; said anchoring alarm generating an alarm output when said shaft of said activation pin is pulled out allowing said alarm contacts to contact each other;

each of said lid alarm and said anchoring alarm having arm and disarm circuitry responsive to said remote control unit;

said remote control unit having a lid arm/disarm button and an anchoring alarm arm/disarm button.

* * * * *